US007870947B2

(12) United States Patent
Mäder et al.

(10) Patent No.: US 7,870,947 B2
(45) Date of Patent: Jan. 18, 2011

(54) GRIPPER FOR HOLDING AND CONVEYING FLAT OBJECTS

(75) Inventors: Carl Conrad Mäder, Hittnau (CH); Konrad Auf der Maur, Gossau (CH)

(73) Assignee: Ferag AG, Hinwil (CH)

( * ) Notice: Subject to any disclaimer, the term of this patent is extended or adjusted under 35 U.S.C. 154(b) by 248 days.

(21) Appl. No.: 12/296,575

(22) PCT Filed: Apr. 7, 2007

(86) PCT No.: PCT/CH2007/000172

§ 371 (c)(1),
(2), (4) Date: Nov. 5, 2008

(87) PCT Pub. No.: WO2007/115421

PCT Pub. Date: Oct. 18, 2007

(65) Prior Publication Data

US 2009/0272630 A1 Nov. 5, 2009

(30) Foreign Application Priority Data

Apr. 12, 2006 (CH) ..... 610/06

(51) Int. Cl.
*B65G 47/86* (2006.01)

(52) U.S. Cl. ..... 198/644; 198/468.2; 198/803.3

(58) Field of Classification Search ..... 198/377.03, 198/377.07, 468.2, 468.3, 470.1, 644, 867.02, 198/867.05, 867.06, 867.07, 803.3, 803.4, 198/803.7, 803.8, 803.9, 803.1; 271/277
See application file for complete search history.

(56) References Cited

U.S. PATENT DOCUMENTS 4,381,056 A * 4/1983 Eberle ..... 198/803.7
4,921,294 A * 5/1990 Klopfenstein ..... 294/99.1
4,968,081 A * 11/1990 Beight et al. ..... 294/104
5,222,727 A * 6/1993 Jacobsen ..... 271/205
5,244,078 A * 9/1993 Silva et al. ..... 198/464.3
5,311,976 A * 5/1994 Backman ..... 198/349.1
5,575,379 A 11/1996 Schmetzer
5,743,377 A * 4/1998 Kronseder ..... 198/803.9
5,755,436 A 5/1998 Reist (Continued)

FOREIGN PATENT DOCUMENTS

DE 3102242 A1 2/1982

*Primary Examiner*—Mark A Deuble
(74) *Attorney, Agent, or Firm*—Rankin, Hill & Clark LLP

(57) ABSTRACT

A gripper for holding and conveying flat objects (P) in a firmly held manner, in particular printed material such as newspapers, magazines or brochures, includes two clamping tongues (4 and 5) which can pivot relative to one another into an open and into a closed configuration, wherein the clamping tongues (4 and 5) are pressed against one another in the closed configuration. The distal ends of at least one of the clamping tongues (4 and 5) are fitted with two elastic arms (30) that extend laterally away from the clamping tongue, in the same direction as the clamping force, a clamping jaw (10, 11) being arranged at the free end of each of the arms. The contact surfaces of the clamping jaws of at least one clamping tongue adapt to fit the contact surface of an opposite clamping jaw or a clamped object, under compression force, for example, they are mounted on the arm (30) by means of a ball joint.

17 Claims, 5 Drawing Sheets

U.S. PATENT DOCUMENTS 6,196,538 B1 * 3/2001 Stauber et al. ..... 271/69
6,578,843 B2 * 6/2003 Honegger ..... 271/204
7,150,454 B2 * 12/2006 Honegger ..... 271/204
7,185,753 B2 * 3/2007 Hartness et al. ..... 198/474.1

* cited by examiner 5
4
30
40
11
10
10.1
10.2
10.3
10.4
50
51
52
53
55
56
60
61
62
63

GRIPPER FOR HOLDING AND CONVEYING FLAT OBJECTS

BACKGROUND OF THE INVENTION

1. Field of the Invention

The invention lies in the field of conveyor technology and relates to a gripper according to the preamble of the independent patent claim. The gripper is suitable for gripping and for the conveying of flat objects while they are held, in particular of printed products such as newspapers, magazines or brochures or of small groups thereof.

2. Description of Related Art

It is known to convey flat objects, in particular printed products such as newspapers, magazines or brochures, in compact conveyor flows, wherein the printed products are conveyed consecutively and aligned essentially parallel to one another, and the conveyor direction is aligned perpendicularly or obliquely (not parallel) to the main surfaces of the printed products. Thereby, the distances between the consecutive printed products is usually significantly smaller that the surface extension. Gripper transporters are applied for example for conveying such compact conveyor flows. These comprise a plurality of grippers which are fastened on a conveyor member, for example on a joint link chain, wherein the chain is revolvingly driven in a channel, and the grippers are designed for gripping a printed product, or a small group of printed products and conveying the product or the products while they are held.

The mentioned grippers usually comprise two clamping tongues, which may be pivoted relative to one another into an open and into a closed configuration with control/cam means arranged along the conveyor path, wherein clamping jaws which are aligned to one another and which are arranged at the distant ends of the clamping tongues, in the open configuration are distanced to one another and not capable of clamping, and in the closed configuration, these clamping jaws are pressed against one another or against a region of a printed product arranged therebetween. For gripping a printed product, a region of this is positioned between the clamping jaws of the open gripper and the gripper is then closed. For the held conveying, the gripper is held in the closed configuration, is advantageously locked in the closed configuration, and is opened or unlocked again for letting go of the printed product.

One example of such a gripper is described in the publication DE-3102242 (or U.S. Pat. No. 4,381,056). The gripper comprises two clamping tongues which are provided with clamping jaws which are aligned to one another. The first clamping jaw is firmly arranged on a gripper body and the second clamping jaw is pivotably arranged in the gripper body with the help of a shaft. The second gripper tongue at its proximal end comprises a spiral spring which is fastened on the shaft and winds around this. The spiral spring remains relaxed as long as the second clamping tongue, when the shaft is rotated relative to the gripper body, moves along with this, which means is accordingly pivoted. If however the clamping jaw of the second clamping tongue bears on the clamping jaw of the first clamping tongue and the shaft is rotated further, the spiral spring tensions and thereby transmits a clamping force onto a printed product clamped between the clamping jaws of the two clamping tongues. A cam lever with a cam roller engages on the shaft of the second clamping tongue for opening and closing the gripper and for chucking the second clamping tongue, and stationary cams are provided along the conveyor path, on which the cam roller rolls. Furthermore, the gripper comprises means with which the second clamping tongue or the shaft is locked in its closed and chucked position relative to the first clamping tongue. For this, in each case a locking element is arranged on the shaft and on the first clamping tongue. As soon as the shaft has reached a predefined rotation position, the locking elements lock into one another. The locking is opened by way of a pawl which is connected to the locking element on the first clamping tongue and which may be activated by a stationary control/cam element.

It is the object of the invention to improve a gripper of the type mentioned above, in particular the gripper according to DE-31202242 described briefly above, to the extent that these grippers may be applied for gripping and conveying a wide spectrum of flat objects. In particular, the grippers according to the invention should be suitable not only for securely gripping thicker and in particular heavier, and also very thin and light, flat objects, and securely conveying them in a held manner, but it should also be suitable for securely gripping flat objects and in particular also groups of flat objects which have regions of different thickness, and securely conveying them in a held manner. Moreover, the gripper according to the invention should also render it possible to grip the mentioned wide spectrum of flat objects in a clamping manner and in a manner such that forces between the clamping jaws of the clamping tongues and the gripped object, or between individual parts of the gripped object, and which act on the printed products in a rubbing and thus smearing manner, may be avoided to a such an extent, that one may also handle printed products on which the printed inks have not yet developed their final resistance to smearing.

BRIEF SUMMARY OF THE INVENTION

One main feature which distinguishes the gripper according to the invention from the known grippers lies in the fact that the distal end of at least one of the clamping tongues of the gripper according to the invention includes two arms, which extend outwards to both sides of the tongue roughly parallel to the pivot axis, and which at their free ends in each case carry a clamping jaw in a manner such that the two clamping jaws are distanced as far as possible from one another. The arms of the at least one clamping jaw thereby are designed in a resilient manner in the direction of the clamping force. Moreover, it is advantageous to direct the two arms, at least of the one clamping tongue slightly towards the other clamping tongue, in a manner such that the two arms on their side facing the other clamping tongue, together form a slightly concave shape.

The clamping jaws which are arranged on the free ends of the arms, advantageously have essentially plane contact surfaces, whose alignment and, as the case may be, shape, may be adapted to the contact surface of the counter clamping jaw or to the clamped in object by way of the clamping force which presses the clamping jaws against one another or against an object clamped in therebetween.

By way of dividing the clamping effect onto two clamping regions which are laterally distanced to one another and which are resiliently connected to one another, one may not only hold a clamped printed product in a more stable manner (less torques acting transversely to the conveyor direction which are to be accommodated by the gripper or the conveyor member), but it is also possible to securely grip an object which has unequal thicknesses in the two clamping regions.

The contact surfaces of the clamping jaws advantageously lie essentially in a plane aligned radially to the pivot axis, wherein not only is the second clamping tongue pivotable about the pivot axis relative to the first clamping tongue, but also the first clamping tongue relative to the gripper body. In a preferred embodiment, the contact surfaces of the clamping jaws of the first clamping tongue lie in a plane aligned radially to the pivot axis, and the contact surfaces of the second clamping tongue form a small angle relative to such a radial plane, in a manner such that the contact surfaces of the clamping jaws of the second clamping tongue are then aligned parallel to the contact surfaces of the clamping jaws of the first clamping tongue when the distance between the contact surfaces of the clamping jaws of the two clamping tongues corresponds roughly to the average thickness of a flat object to be handled.

By way of the arrangement of the contact surfaces of the clamping jaws essentially in a plane aligned radially to the pivot axis, one succeeds in the centre of gravity of a gripped printed product, when it is conveyed hanging freely (first clamping tongue and thus locked second clamping tongue freely pivotable relative to the gripper body), being arranged below the pivot axis, so that at least with such a conveying, no torque is to be taken up by the gripper body or the conveyor element in a plane parallel to the conveyor direction, and the object is not bent. On account of the mentioned alignment of the contact surfaces of the two clamping tongues relative to one another, one succeeds in sliding movements transverse to the clamping movement being reduced to a minimum on compressing a printed product to be gripped between the clamping jaws of the clamping tongues.

BRIEF DESCRIPTION OF THE DRAWINGS

Exemplary embodiments of the gripper according to the invention are described in detail by way of the following figures. Thereby, there are shown in FIGS. 1 to 3 a preferred embodiment of a gripper according to the invention, in different conditions (lateral views).

DETAILED DESCRIPTION OF THE INVENTION

Figure 1:
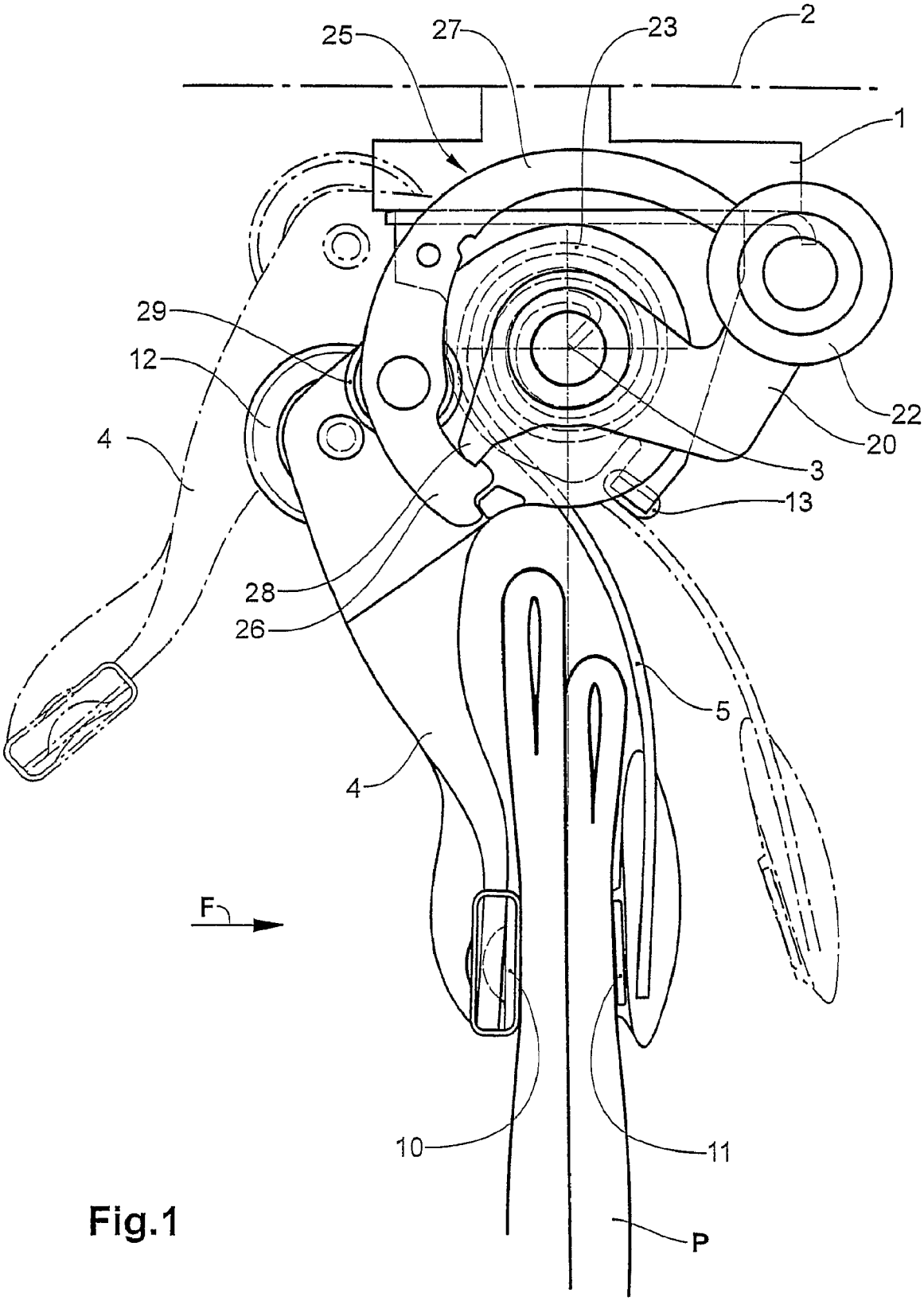
Figure 2:
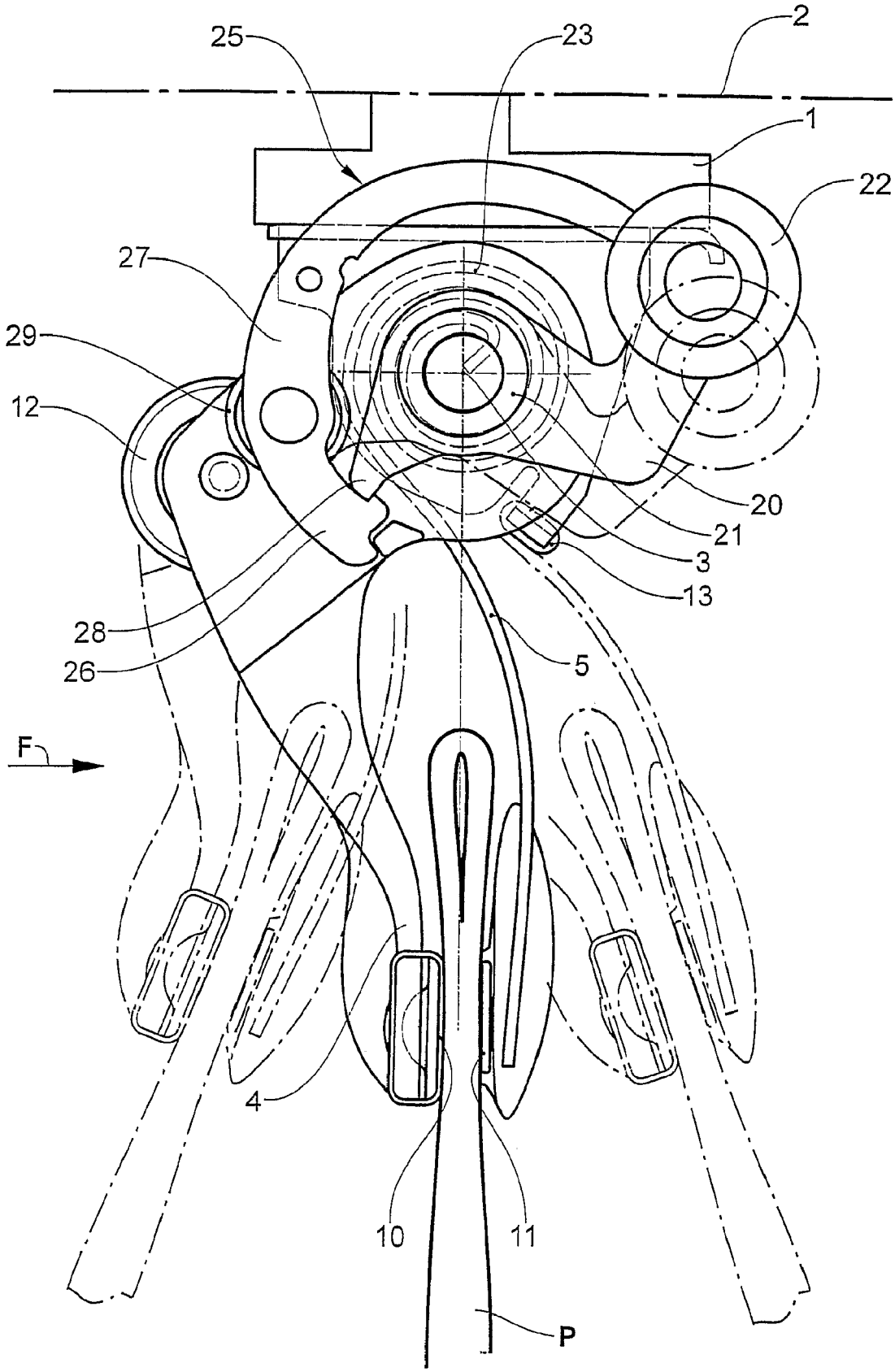
Figure 3:
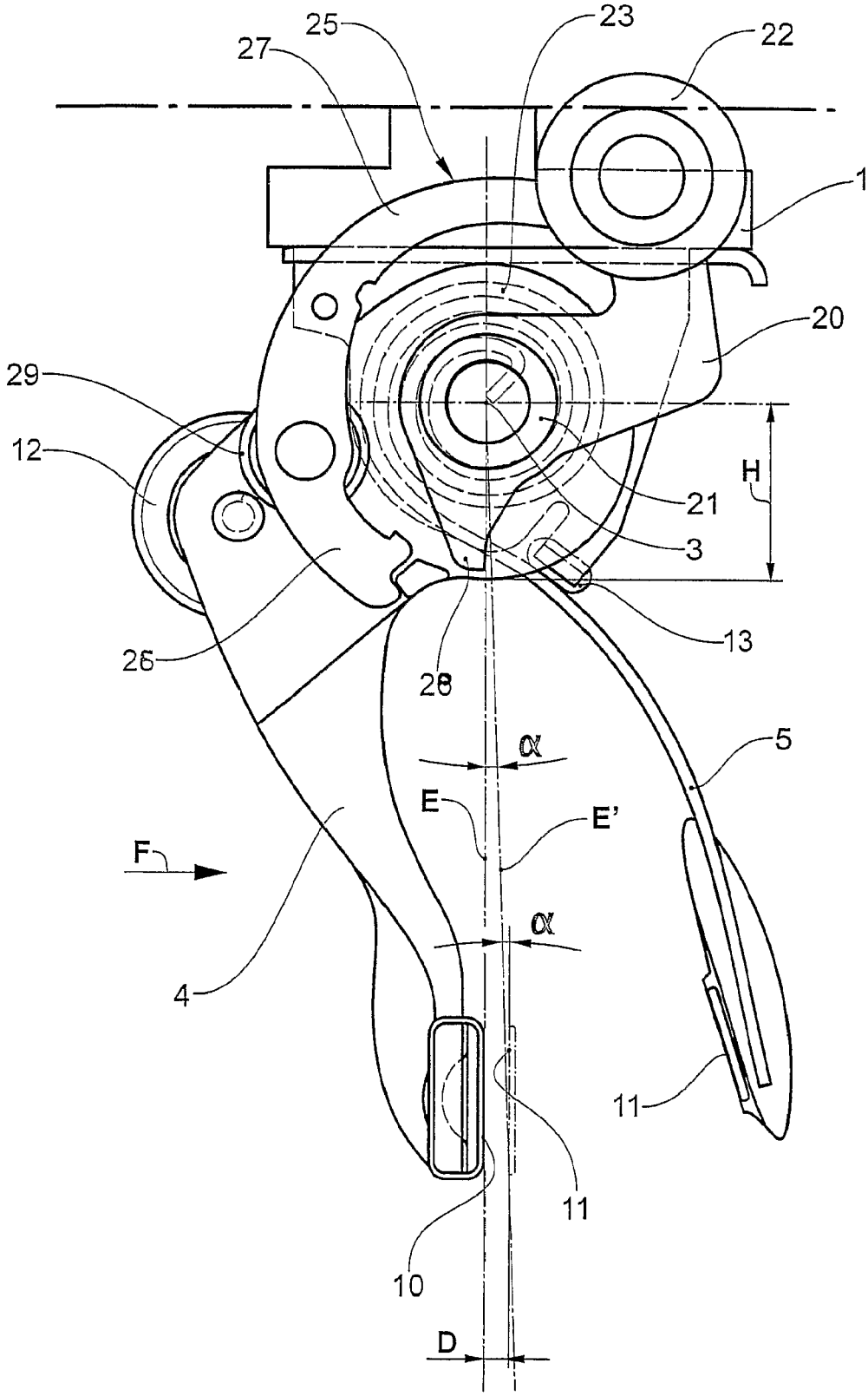

FIGS. 1 to 3 show a preferred embodiment of the gripper according to the invention, seen from the side, which means with a viewing direction transverse to the conveyor direction. In FIG. 1, the gripper is represented in an unbroken manner in the closed condition, with two printed products P which are clamped between the clamping jaws and which are conveyed in a freely hanging manner, and in a dot-dashed manner in an open condition. FIG. 2 shows the gripper in an unbroken manner again in the closed condition with a printed product P conveyed in a freely hanging manner, and likewise in a dot-dashed manner in the closed condition, wherein however, the clamping tongues are pivoted relative to the conveyor element or gripper body. FIG. 3 shows the gripper again in an open condition.

The gripper comprises a gripper body 1 which is assembled on the conveyor element (indicated by the dot-dashed line 2). The first clamping tongue 4 is mounted in the gripper body 1 pivotably about a pivot axis 3. The second clamping tongue 5 is pivotably mounted about the same pivot axis 3 in the first clamping tongue 4. The pivot axis 3 is aligned perpendicularly to the conveyor direction F and the first clamping tongue 4 is the trailing clamping tongue. Both clamping tongues at their distal ends in each case comprise a pair 10 and 11 of clamping jaws which are distanced to one another transversely to the pivot movement or conveyor direction, wherein of each pair 10 and 11, only one clamping jaw is visible in the FIGS. 1 to 3. The clamping jaws are described in more detail with regard to the FIGS. 4 to 9.

The pivot position of the first clamping jaw 4 relative to the gripper body 1 is determined on the one hand by a cam roller 12, which rolls on corresponding stationary cams which are not shown, and on the other hand by an expander spring (not shown), which is arranged between the first and the second clamping tongue and keeps these in a position in which they are as remote as possible from one another, wherein the outermost positions of the two camping tongues 4 and 5 are defined by suitable abutments (for the second clamping tongue: abutment 13) on the gripper body 1. The two gripper tongues are represented in a dot-dashed manner in FIG. 1 in their outermost position which is defined by the expander spring and the abutments.

The pivot position of the second clamping tongue 5 relative to the first clamping tongue 4 is determined by a cam lever 20. This engages on the shaft 21 and carrier a further cam roller 22, wherein the shaft is rotatably mounted in the first clamping tongue 4 and the second clamping tongue 5 is fastened on the shaft. This further cam roller 22 also rolls on cams (not shown) which are arranged in a stationary manner. If the cams press the further cam roller 22 downwards, then this rotates the shaft 21 in the clockwise direction, so that the second clamping tongue 5 is moved against the first clamping tongue 4. Since the second clamping tongue 5 is fastened on the shaft 21 via a spiral spring 23, the shaft may be rotated further under the tension of the spiral spring 23, even if the second clamping tongue 5 may not be pivoted any further, since its clamping jaws 11 abut on the clamping jaws 10 of the first clamping tongue 4 or on an object which is clamped between the two clamping jaws. The spiral spring 23 is tensioned by way of such a further rotation and a clamping force is built up. The clamping jaws are locked with one another in a predefined rotation position of the shaft 21 relative to the first clamping tongue 4.

For the locking function, a locking pawl 25 with a locking lever 26 and a cam lever 27 is rotatably arranged, for example, on the first clamping tongue 4, and the cam lever 20 fastened on the shaft 21 comprises a locking element 28 which cooperates with the locking lever 26. The locking lever 26 of the pawl 25 is brought from a locking position (FIGS. 1 and 2 unbroken) into an idle position (FIG. 3) against the force of a biased adjustment spring 29 by way of a cam element (not shown) which is arranged in a stationary manner and acts on the cam lever 26 of the locking pawl 25, wherein the tension of the spring 23 reduces and the expander spring opens the gripper. As soon as the shaft 21 has reached a rotation position relative to the first clamping tongue 4, which is defined by the cam pawl 25 and the locking element 28, the locking lever 26 and the locking element 28 snap into a locking position which may only be released again by way of the actuation of the cam lever 27 of the locking pawl 25, which is described above.

In the condition of the gripper which is shown in an unbroken manner in FIG. 1, the two clamping tongues are locked with one another. A stationary cam is missing, on which the cam roller 12 determining the pivot position of the first clamping tongue 4 rolls, so that this pivot position is determined by gravity. As already mentioned further above, the gripper is designed in a manner such that the clamping jaws 10 and 11 of the two gripper tongues 4 and 5 maintain an object P clamped therebetween, aligned radially to the pivot axis 3, so that the centre of gravity of the object P lies perpendicularly below the pivot axis. This means that the object is not bent by gravity and effects no torque which would have to be taken up by the clamping tongues 4 and 5, by the gripper body 1, and finally by the conveyor element.

The condition of the gripper represented in a dot-dashed manner in FIG. 1 is the open condition, in which the positions of the two clamping tongues 4 and 5 are determined by the expander spring and by the abutments 13 on the gripping body 1.

The gripper condition represented in an unbroken manner in FIG. 2 is again the closed and locked condition, wherein the pivot position of the first clamping tongue 4 relative to the gripper body 1 is determined, for example, by gravity. By way of a suitable control of the cam roller 12 or by way of suitable change of the position of the gripper body 1 or of the conveyor member relative to gravity, the first clamping tongue 4 together with the second clamping tongue 5 which is locked thereto, may be brought into other pivot positions, e.g. into the two pivot positions which are represented dot-dashed in FIG. 2, wherein the relative position of the pivot axis and the centre of gravity of the gripped object remains unchanged in the case of a position change of the gripper body.

FIG. 3 serves for illustrating a preferred mutual alignment of the contact surfaces of the clamping jaws 10 and 11 of the two clamping tongues 4 and 5. The contact surfaces of the clamping jaws 10 of the first clamping tongue 4 are positioned in a perpendicular plane E, which is aligned radially to the pivot axis 3. The second clamping tongue 5 is represented in its open position and in a dot-dashed manner in that position, in which the rest surfaces of its clamping jaws 11 are aligned parallel to the contact surfaces of the clamping jaws 10 of the first clamping tongue 4. From this, it is evident that the alignment of the contact surfaces of the clamping jaws 11 form an angle $\alpha$ with the corresponding radial plane E'. This angle corresponds to the pivot angle between the first and the second clamping tongue at a distance D which corresponds to an average thickness of the objects to be handled.

From the FIGS. 1 to 3, it is evident that the grippers according to the invention have a very compact constructional manner which, given an equal construction height as known grippers, permits a significantly greater depth of the gripper jaw. This means that the clamping region of a gripped object may be gripped further from its edge than is the case with known grippers. The clamping regions of a gripped object lie distanced further from its edge, thus closer to its centre of gravity (smaller lever arms for the load forces), on account of the greater depth of the gripper jaw. By way of this, it is also possible to securely grip groups of printed products lying on one another in a staggered manner and to convey them in a held manner, as represented in FIG. 1. Amongst others, the cam lever 27 of the locking pawl 25 which leads in the conveyor direction, which is different to the state of the art, contributes to this compact construction manner.

In the preferred embodiment of the gripper according to the invention represented in the FIGS. 1 to 3, the distance H between the pivot axis and the innermost point of the gripper jaw is reduced to a minimum, in a manner such that the gripper comprises a gripper jaw depth which makes up approx. 75% of the distance between the pivot axis and clamping jaws.

Figure 4:
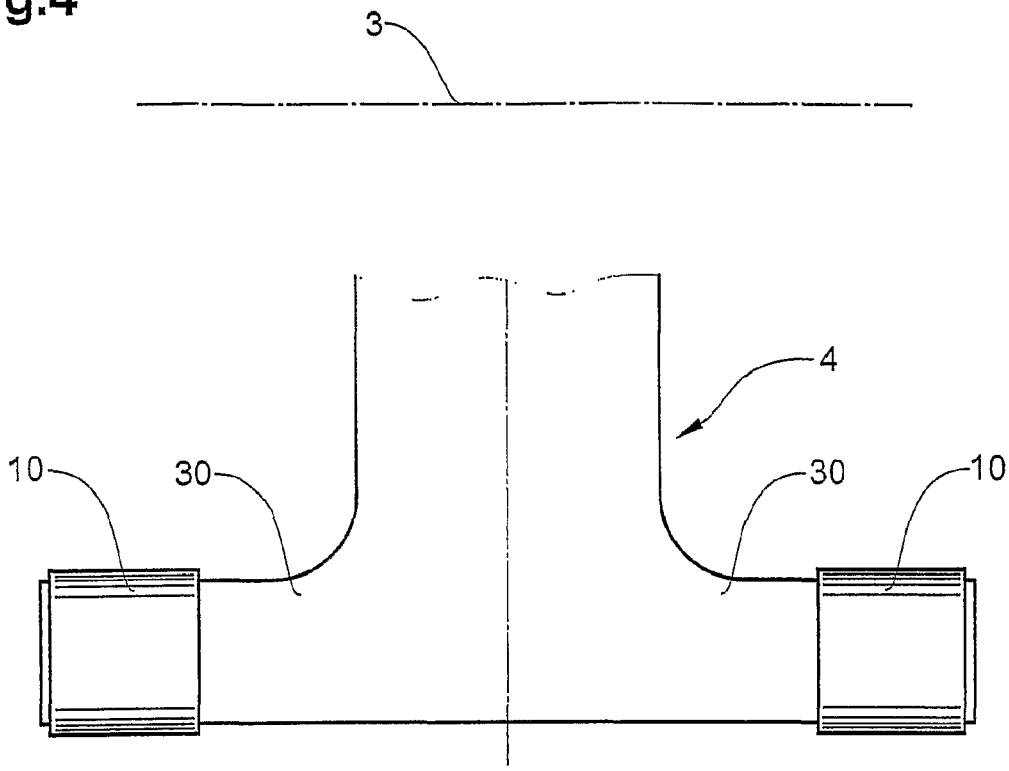
FIGS. 4 and 5 the distal ends of the two clamping tongues of the gripper according to FIGS. 1 to 3, seen in the conveyor direction.

FIG. 4 shows an exemplary embodiment of the distal end of the first clamping tongue 4 of a gripper according to the invention with a viewing angle parallel to the conveyor direction. This distal end on both sides comprises an arm 30 projecting from the tongue roughly parallel to the pivot axis 3, on which arm in each case a clamping jaw 10 is arranged in a position lying as far to the outside as possible. The clamping jaws are, for example, annular and are stuck onto the arms 30 from their free end. The first clamping jaw, for example, consists of a plastic and the arms are not or are only designed in a slightly resilient manner.

Figure 5:
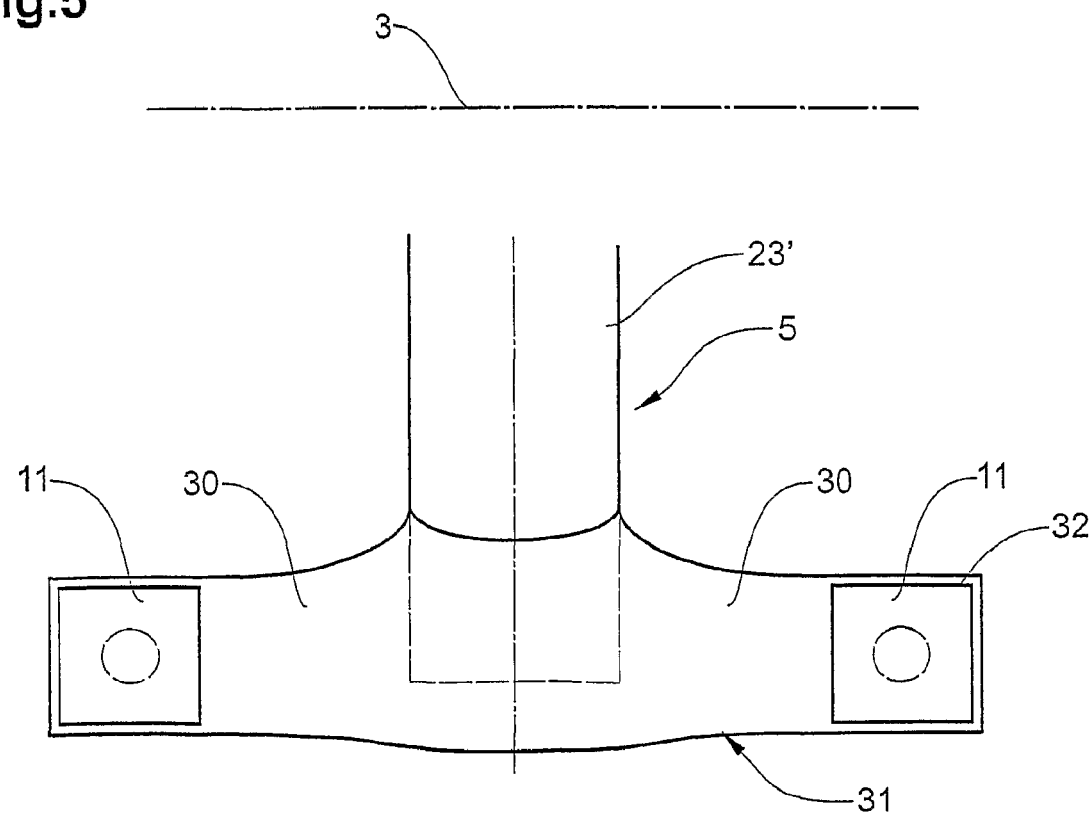

FIG. 5 shows an exemplary embodiment of the distal end of the second clamping tongue 5 of the gripper according to the invention. This clamping tongue too comprises lateral arms 30 which carry the clamping jaws 11 in outer positions. The clamping jaws 11 are, for example, snapped or inserted in openings 32 of the arms 30. The arms 30 of the second clamping tongue 5 are for example part of a distal attachment 31 which is stuck onto a part 23' of the spiral spring (23 in FIGS. 1 to 3) forming the actual clamping tongue 5. Thereby, the attachment is preferably designed in a manner such that the arms 30 are resilient parallel to the pressing force, which means perpendicular to the plane of the paper of FIG. 5. Advantageously, the attachment is bent perpendicularly to the plane of the paper, in a manner such that the clamping jaws project in the direction of the first clamping tongue beyond a middle region of the attachment. The attachment 31 consists, for example, of a plastic and the spring 23 of spring steel.

For conveyor devices which are suitable for conveying objects of the format and weight, for example, of newspapers or magazines, it is advantageous to arrange the two clamping jaws of a clamping tongue at least 10 cm from one another.

It is also possible to only equip the one clamping jaw with the arms described above and two clamping jaws, whilst the other clamping tongue is correspondingly wide and comprises a single correspondingly wide clamping jaw.

FIGS. 6 to 9 in a lateral view show different embodiments of clamping jaws 10 and 11 for the clamping tongues 4 and 5 of the gripper according to the invention. The clamping jaw 11 of the second clamping tongue, in all FIGS. 6 to 9, is a profile with a cavity 40 which is, for example, integrally formed on the arm 30. The hollow profile has an elastically deformable cover layer which is directed against the clamping jaw 10 of the first clamping tongue 4 and, thus, forms the contact surface of the clamping jaw 11.

The clamping jaws 10.1 to 10.4 of the first clamping tongue 4 which are represented in the FIGS. 6 to 9 are represented separately also in a three-dimensional manner.

Figures 6, 7, 8, 9:
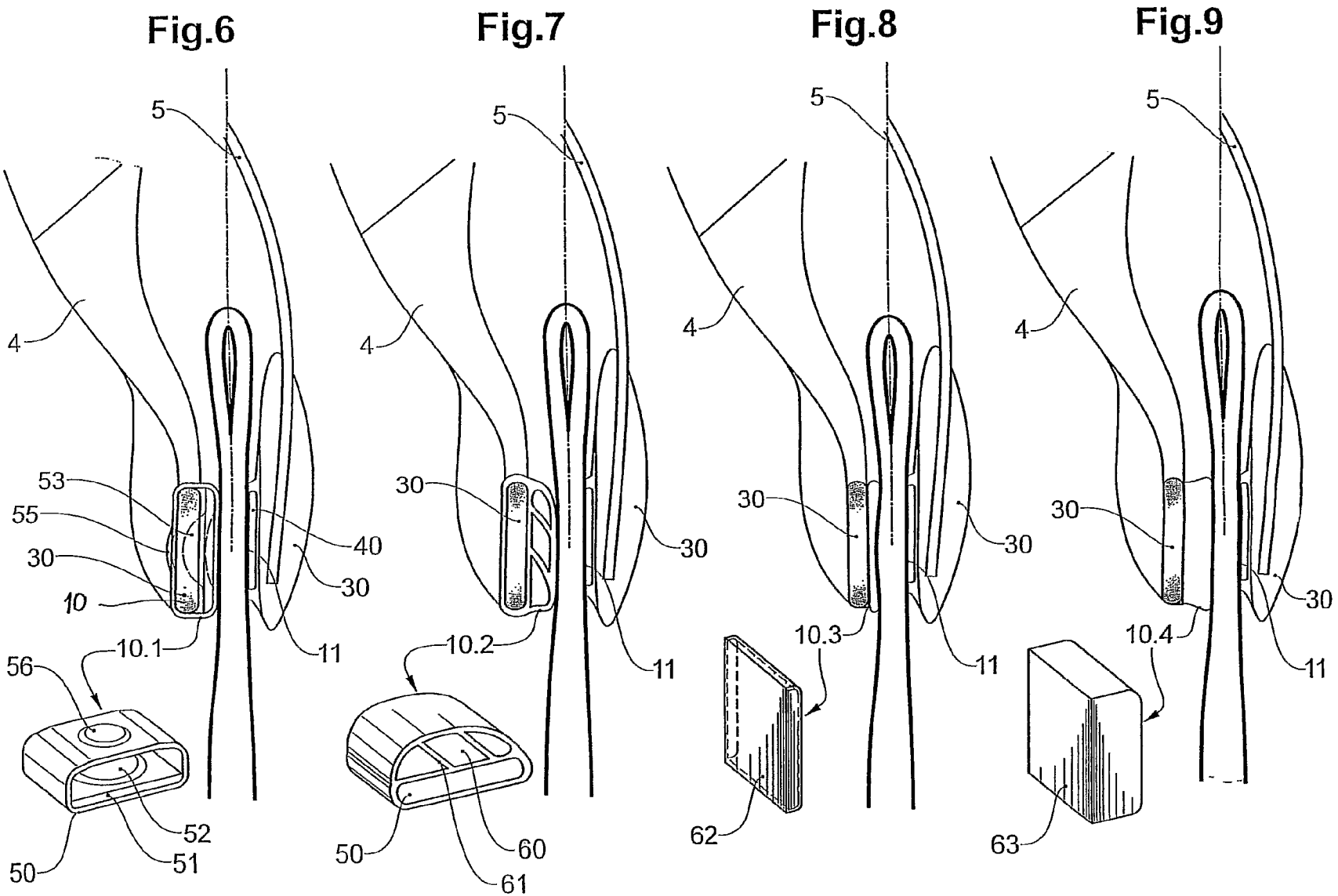
FIGS. 6 to 9 different embodiments of clamping jaws for the grippers according to the invention.

The clamping jaw 10.1 according to FIG. 6 may be stuck onto the arm 30 from the free arm end. For this, it comprises a tubular carrier part 50 which is limited with regard to its elasticity. An inner plate 51 which in its middle comprises a ball calotte 52, is arranged in the tubular carrier part. The arm 30 at a corresponding location has a recess 53 corresponding to the ball calotte 52, whose depth is somewhat smaller than the height of the ball calotte 52. If the clamping jaw 10.1 is stuck on the arm 30, the ball calotte 52 is positioned in the recess 53 such that the plate 51 is mounted via a ball joint on the arm 30. The inner plate 51 may be adapted in all directions to the contact surface of a counter clamping jaw or to a gripped object by way of this.

A formation 55 which in cooperation with an indentation 56 of the tubular carrier 50 of the clamping jaw 10.1 fixes this on the arm, is additionally represented in FIG. 6 on the side of the arm 30 which is distant to a gripped object.

The clamping jaw 10.2 which is represented in FIG. 7 may likewise be stuck onto the arm 30 from the side and for this comprises a tubular carrier part 50 which is elastic in a limited manner. A laterally open, for example multi-chambered hollow profile 60, is arranged on this carrier part 50 and forms a cushion-like contact surface on advantageously oblique supports 61.

The clamping jaw 10.3 represented in FIG. 8 consists essentially of a flat cushion 62 which is closed on all sides, is filled with a fluid and is bonded for example on the arm 30.

The clamping jaw 10.4 represented in FIG. 9 consists of a flat block 63 of an elastically deformable (e.g. visco-elastically deformable material), wherein the block 63 is likewise fastened on the arm 30 by way of bonding for example.

The clamping jaws represented in the FIGS. 6 to 9 are exemplary embodiments of clamping jaws which are suitable for the gripper according to the invention and which by way of the clamping force exerted onto the clamping tongues, may be adapted to a counter-jaw or to a clamped object. Further embodiments of these clamping jaws result from other combinations or the features of the represented clamping jaws. In particular, the clamping jaws represented as clamping jaws 10 of the first clamping tongue 4 may also be used as clamping jaws 11 of the second clamping tongue 5 and vice versa.

It has been found to be advantageous to treat the contact surfaces of the clamping jaws such that they are ink-repelling, which represents a further measure against the smearing of the printed products. Respective treatments are known from other applications (e.g. conveyor belts).

The gripper represented in the FIGS. 1 to 3 is likewise a preferred embodiment of the gripper according to the invention. Further embodiments of these grippers differ from the represented grippers for example by way of the following features:

- The first clamping tongue 4 is not pivotable relative to the gripper body 1;
- The second clamping tongue 5 is a resilient element which is fastened on the shaft without a spiral spring, and locks the two clamping jaws against one another;
- Both clamping jaws are resilient elements;
- The expander spring between the two clamping tongues is absent;
- The arms 30 of both or only the second clamping tongue are designed in a resilient manner;
- Only one of the two clamping tongues comprises lateral arms 30 with in each case a clamping jaw, whist the other clamping tongue has a single clamping jaw;
- The clamping jaws of at least the one clamping tongue are not adaptable;
- A means for locking the two clamping tongues is absent in the closed configuration.

The invention claimed is:

1. A gripper for gripping and conveying of flat objects, in particular of printed products such as newspapers, magazines or brochures, or of small groups thereof, said gripper comprising:

a gripper body, a first clamping tongue comprising clamping jaws at its distal end, a second clamping tongue comprising clamping jaws at its distal end and being pivotable relative to the first clamping tongue about a pivot axis, and a means for producing a clamping force, wherein the gripper may be brought into an open and into a closed configuration by way of pivoting the first and second clamping tongues with respect to one another, wherein the clamping jaws of the two clamping tongues bear on one another or on a clamped object in the closed configuration, and are pressed against one another by the clamping force, further comprising: two laterally extending arms arranged at least one of the two clamping tongues at its distal end, wherein the arms are resilient in a direction parallel to the clamping force, and a clamping jaw with a contact surface provided on each of the arms, in a manner such that a clamped object is clamped in two clamping regions which are distanced from one another.

2. A gripper according to claim 1, wherein both clamping tongues at their distal ends comprise laterally arranged resilient arms with, in each case, a clamping jaw.

3. A gripper according to claim 1, wherein the contact surfaces of the clamping jaws may be adapted to the opposite clamping jaw or to a clamped object, by way of the clamping force.

4. A gripper according to claim 3, wherein the contact surfaces of the clamping jaws are mounted on the arm via a ball joint.

5. A gripper according to claim 3, wherein the contact surfaces of the clamping jaws are mounted on the arms via an elastically deformable hollow profile, via an elastically deformable material or via a fluid.

6. A gripper according to claim 1, wherein the contact surfaces of the clamping jaws are treated in a manner such that they act in an ink-repelling manner.

7. A gripper according to claim 1, wherein the contact surfaces of the clamping jaws, at least of the one clamping tongue, lie in a plane aligned radially to the pivot axis.

8. A gripper according to claim 7, wherein the contact surfaces of the clamping jaws of the first clamping tongue lie in a plane aligned radially to the pivot axis and that the contact surfaces of the clamping jaws of the second clamping tongue form an angle with a plane aligned radially to the pivot axis, in a manner such that the contact surfaces of the clamping jaws of the two clamping tongues are aligned parallel to one another when an object of an average thickness is clamped between the clamping jaws.

9. A gripper according to claim 1, wherein the clamping jaws comprise a tubular carrier and are mounted onto the arms from the side.

10. A gripper according to claim 1, further comprising a locking means which is designed for locking the clamping tongues in the closed configuration.

11. A gripper according to claim 1, wherein the first clamping tongue is pivotable relative to the gripper body, in a manner such that the two clamping tongues are freely pivotable relative to the gripper body, at least in the closed configuration.

12. A gripper according to claim 10, wherein the second clamping tongue is fastened via a spiral spring on a shaft which is rotatably mounted in the first clamping tongue, wherein the spiral spring winds around the shaft.

13. A gripper according to claim 12, wherein the locking means engage on the first clamping tongue and on the shaft of the second clamping tongue.

14. A gripper according to claim 1, wherein an expander spring is provided, by way of which the two clamping tongues are held in the open configuration.

15. A gripper according to claim 1, wherein a gripper jaw depth makes up about 75% of the distance between the clamping jaws and the pivot axis.

16. A gripper according to claim 12, wherein the second clamping tongue is formed by a part of the spiral spring and that the arms are part of an attachment which is mounted onto the spiral spring in the distal region.

17. A gripper according to claim 16, wherein the attachment is made of a plastic material, and the spiral spring is made of spring steel.

* * * * *